United States Patent [19]

Miszak

[11] 4,430,962

[45] Feb. 14, 1984

[54] FORCED FLOW VAPOR GENERATOR PLANT

[75] Inventor: Pawel Miszak, Winterthur, Switzerland

[73] Assignee: Sulzer Brothers Ltd., Winterthur, Switzerland

[21] Appl. No.: 331,372

[22] Filed: Dec. 16, 1981

[30] Foreign Application Priority Data

Dec. 23, 1980 [CH] Switzerland ..... 9497/80

[51] Int. Cl.[3] ..... F22D 7/00

[52] U.S. Cl. ..... 122/406.5; 660/652; 660/657; 122/406 ST

[58] Field of Search ..... 122/406 S, 406 ST, 448 S; 60/646, 657, 658, 652, 670

[56] References Cited

U.S. PATENT DOCUMENTS

| | | | |
|---|---|---|---|
| 3,789,806 | 2/1974 | Gorzegno | 122/406 S |
| 4,290,389 | 9/1981 | Palchik | 122/406 S |
| 4,290,390 | 9/1981 | Juzi | 122/406 S |

*Primary Examiner*—Allen M. Ostrager

*Attorney, Agent, or Firm*—Kenyon & Kenyon

[57] ABSTRACT

The vapor generator is constructed with an evaporator of vertical tubes about the combustion chamber and a final evaporator which is disposed between the economizer and at least one superheater within the flue of the generator. The first superheater tubes are vertically disposed and are welded to the tubes of the evaporator in a seamless manner and connect with the vapor outlet of the water separator.

5 Claims, 1 Drawing Figure

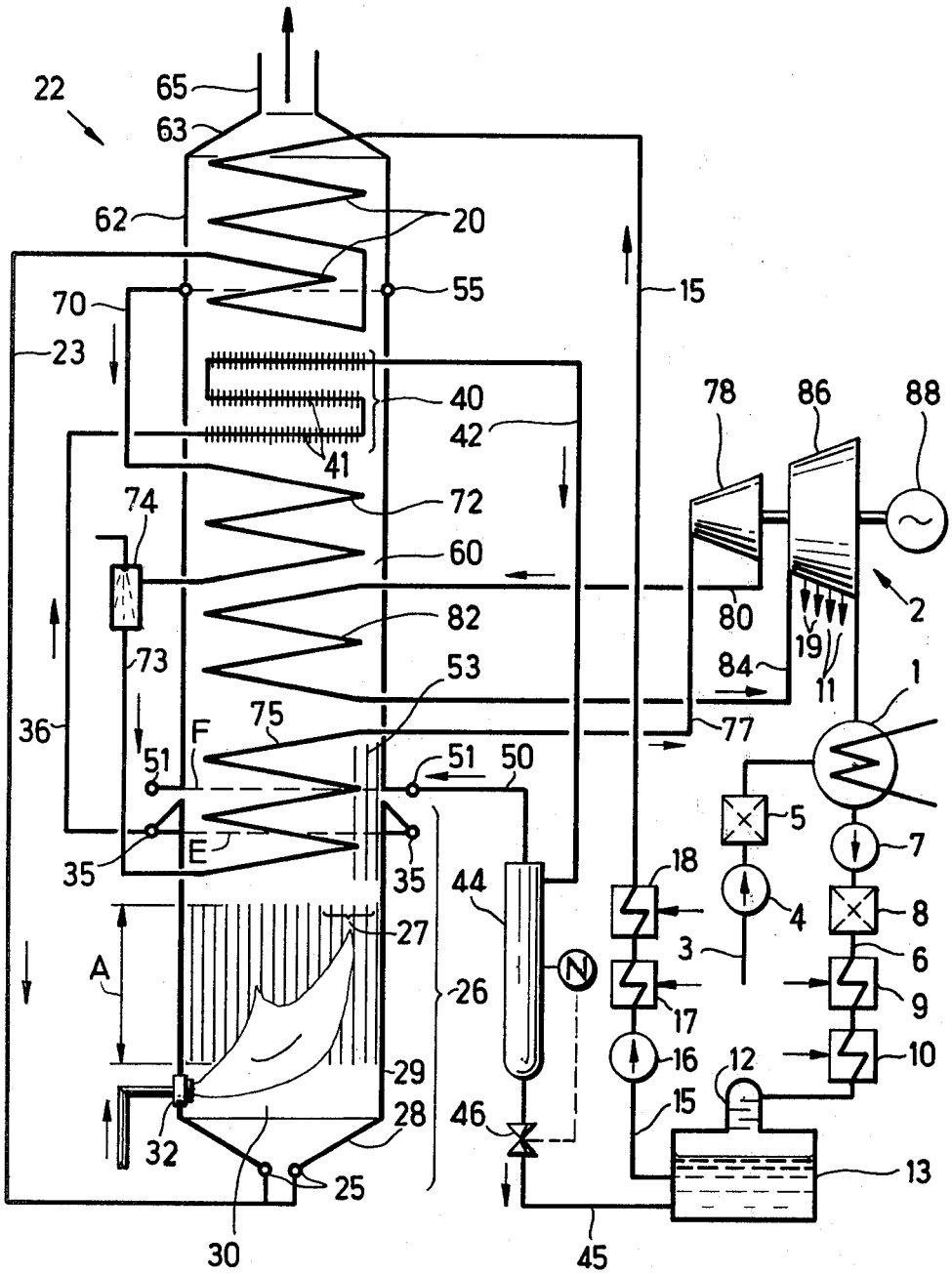
22
65
63
62
20
55
15
70
23
40
42
41
78
86
88
74
72
60
82
80
2
19
11
84
73
53
1
36
75
77
F
51
51
50
5
7
35
E
35
44
18
4
8
27
3
6
A
26
N
17
9
16
12
10
29
15
28
46
13
32
25
30
45

FORCED FLOW VAPOR GENERATOR PLANT

This invention relates to a forced flow vapor generator plant. More particularly, this invention relates to a fossil-fuel-fired forced flow vapor generator plant.

Heretofore, various types of forced flow vapor generator plants have been used to generate a vapor from a working medium in order to operate a turbine from which power can be derived. For example, in many cases, the plants have used vapor generators in which a plurality of tubes which carry the working medium define the walls of a combustion chamber as well as an evaporator. In some cases, during operation some of the working medium issuing from the combustion chamber wall tubes is returned to the entry of these tubes up to the time of high loadings of the plant. This forced circulation ensures that the working medium flows through so fast at all loads that the exposed combustion chamber wall tubes are always satisfactorily cooled by the working medium.

As is known, a differential heating of the various tubes is almost inevitable in vertical tube systems. Hence, the known plants which use such tube systems are operated at supercritical pressure over the entire load range so that the relatively intense evolution of vapor associated with increased heating and, possibly being a cause of flow instability at subcritical pressure, is obviated.

However, when a vapor generator is operated at supercritical pressure on low loads, the live steam pressure must be throttled before the turbine in dependence on its through-put vs. pressure characteristics. Since this throttling is associated with a considerable temperature drop and since turbines are sensitive to abrupt temperature changes, supercritical operation on low loads requires a substantial limitation on the rate of load change. The load-dependent expansion of the vapor can, of of course, be shifted to the vapor generator, preferably to a superheater entry, and the vapor temperature at the generator exit can be kept constant e.g. by control of water injection. However, it is then necessary to provide additional throttle elements which, if the system operates on a restricted pressure basis for a prolonged period, may wear prematurely because of their heavy loading.

Some decades ago, before the water preparation art was at its present-day level, salt deposits were able to form in the terminal parts of the evaporator tubes on the water side. These deposits, in turn, insulated the tubes from the cooling medium and so the tubes overheated and burst. To obviate this, the terminal parts of the evaporator were shifted to a relatively lightly heated zone of the vapor generator. This step had two effects. First, because of the decreased temperature difference between the flue gas and the working medium, final evaporation spread over a considerably increased length of the tubing, and so, the coating or covering of salt built up much more slowly. Second, because of the decreased thermal loading, even relatively thick salt deposits did not lead to overheating of the tubes. Also, tube bursts could be avoided by flushing out the salt deposits periodically.

With the advent of modern water preparation technology, which led to the high degree of purity, the terminal parts of the evaporator ceased to be placed in the lightly heated zone for several reasons. However, one particular disadvantage that resulted was that the heat absorption of the combustion chamber walls, which were designed as evaporator walls, was reduced. Further, one property of what used to be the very desirable properties of final evaporation occurring in a lightly heated zone, namely heat absorption extending over a relatively large heating surface, is a disadvantage in modern systems since this increases boiler weight.

Accordingly, it is an object of the invention to operate a fossil-fuel-fired vapor generator plant in an efficient manner through a sliding pressure operation.

It is another object of the invention to provide a vapor generator plant which can be reliably operated over a prolonged period of partial load operation.

It is another object of the invention to provide a vapor generator plant which can be operated in a manner which permits rapid changes of load.

It is another object of the invention to construct a vapor generator plant in a relatively simple manner to achieve an efficient operation.

It is another object of the invention to reduce the weight of a vapor generator of a fossil fuel plant.

It is another object of the invention to provide a vapor generator which can be constructed in an operational manner.

Briefly, the invention provides a forced flow vapor generator plant which includes a treatment means for desalinating a flow of water, a high pressure feed pump, a vapor generator and a water-separating means.

The treatment means is constructed in known manner so as to desalinate a flow of water to a conductivity of less than 0.2 microsiemens per centimeter and to a silicon content of less than 0.02 parts per million (ppm).

The feed pump serves to pump a flow of water from the treatment means to the vapor generator.

The vapor generator has a plurality of vertical tubes which are disposed in seal-tight relation to each other in order to define an evaporator about a combustion chamber. In addition, the generator has a plurality of vertical tubes disposed in seal-tight relation to each other and to the evaporator tubes in order to define a superheater about a flue above the combustion chamber. Also, the generator has an economizer within the flue which is connected to and between the feed pump and the evaporator in order to deliver a heated flow of water to the evaporator. Furthermore, the generator has a final evaporator within the flue between the economizer and the superheater. This final evaporator is connected to the evaporator in order to receive a mixture of water vapor therefrom.

The water-separating means is connected to the final evaporator in order to receive a mixture of water and vapor. This water-separating means also has a return line which communicates with a position between the water treatment means and the evaporator in order to return separated water thereto as well as a tube which communicates with the superheater in order to deliver vapor thereto.

The plant is constructed so as to be operable on a once-through flow through the evaporator in a load range above 50% of full load.

The plant is able to operate very efficiently by virtue of a sliding pressure operation and can operate reliably over a prolonged period of partial load while permitting rapid changes of load.

As compared with a plant in which wall tubes extend sinuously around the combustion chamber, the vapor generator plant has the advantages of cheaper and quicker production and fewer production risks.

The final evaporator may be constructed of a plurality of tubes each of which carries a plurality of fins on the outside. This helps to reduce the weight of the evaporator as well as the amount of material required for fabricating the evaporator.

The vertical tubes of the evaporator defining the combustion chamber walls may each have internally disposed helical grooves at least in a zone of maximum heat incidence. This enables the thermal loading of the combustion chamber walls to be increased. As is known, in vertical combustion chamber walls, that side of the tubes which experiences flame radiation is heated more strongly than the opposite side. Hence, film evaporation may occur on the inside of the tubes near the zone of heating. This, in turn, may lead to excessive tube wall temperatures. However, the helical grooves in the inside wall inpart a rotation to the working medium because of the longitudinal direction of flow of the medium. This rotation, in turn, causes the relatively heavy liquid phase of the working medium to be centrifuged onto the wall. A thermal loading of the tubes can therefore be increased beyond the extent which could be expected as a result of the increase in superficial area. This effect occurs more particularly in the case of vertical tubes through which the flow occurs in an upward direction.

These and other objects and advantages of the invention will become more apparent from the following detailed description taken in conjunction with the accompanying drawing wherein:

The drawing illustrates a schematic view of a vapor generator plant constructed in accordance with the invention.

Referring to the drawing, the vapor generator plant includes a condenser 1 for condensing steam received from a turbine set 2. In addition, a water line 3 delivers water from a suitable source via a water pump 4 and a water treatment system 5 to the condenser 1. The condenser 1 has a condensate line which extends from a sump of the condenser via a condensate pump 7, a condensate treatment system 8 and two condensate preheaters 9, 10 to the entry of a deaerator 12 disposed on a feed water tank 13.

The treatment system or means 8 is constructed so that the treated condensate is substantially salt free. For example, the treatment system 8 is constructed so as to desalinate a flow of water to a conductivity of less than 0.2 microsiemens per centimeter and to a silicon content of less than 0.02 parts per million. The additional water treatment system 5 helps to relieve the condensate treatment system 8 and to protect the condenser 1.

The tank 13 is connected to a feed water line 15 which passes via a high pressure feed pump 16 and a pair of high pressure preheaters 17, 18 to an input of an economizer 20 of a force-flow vapor generator 22.

As illustrated, the economizer 20 has an exit which communicates via a line 23 with a distributor 25 of an evaporator heating surface 26. This evaporator 26 is formed of a plurality of vertical tubes 27 which are disposed in seal-tight relation to each other. The tubes 27 which are welded to each other form a funnel-shaped base 28 and four plane walls 29 to define a combustion chamber 30 of the vapor generator 22. The tubes 27 extend vertically in the walls 29 and are formed with internal helical grooves (not shown) within a zone A of maximum heat incidence. As indicated, the combustion chamber 20 has a firing system 32 which generates a flame.

The tubes 27 of the evaporator 26 are bent outwardly in alternating fashion from the walls 29 at the levels of two horizontal planes E, F and extend to headers 35. The headers 35, in turn, communicate via a line 36 with a final evaporator 40 which is constructed of a system of tubes 41 which are provided with fins. This final evaporator 40 is disposed immediately below the economizer 20 in a flue 60 which extends upwardly from the combustion chamber 30. The exit of the final evaporator 40 is connected via a line 42 to the imput of a water separating means 44.

The water separating means 44 has a return line 45 which communicates with a position between the water treatment means 8 and the evaporator 20 for returning separated water thereto. As indicated, the return line 45 connects with the feed water tank 13. In addition, a level-controlled valve 46 is disposed in the return line 45 to open and close in accordance with the level of water within the separating means 44. In addition, the water separating means 44 has a tube 50 which communicates with a ring distributor 51 in order to deliver vapor thereto.

The ring distributor 51 communicates with a plurality of vertical tubes 53 of the vapor generator 22. These tubes 53 enter the wall 29 alternately in the horizontal planes E, F and are welded in seal-tight relation to each other as well as to the evaporator tubes 27 so that the combustion chamber 30 merges into the flue 60 in a seamless manner. The vertical tubes 53 serve to define a first superheater of the vapor generator 22.

As indicated, the flue 60 is bounded at the upper part by uncooled metal walls 62 and a cover 63 which merges into a chimney 65.

The vapor generator 22 also has a second superheater 72 and a final superheater 75 connected in series via lines 70, 73 to a header 55 of the wall tubes 53. In addition, an ejector 74 is disposed within the line 73 for purposes as explained below. The outlet of the final superheater 75 communicates via a live steam line 77 with a high pressure turbine 78. The exit of the turbine 78 is connected via a feed line 80 to a reheater 82 which is disposed in the flue 60 of the vapor generator between the superheaters 72, 75. An outlet of the reheater 82 communicates via a return line 84 with a low pressure turbine 86 which together with the high pressure turbine 78 and a generator 88, all mounted on a common shaft, forms the turbine set 2. The low pressure turbine 86 also has a pair of bleeds 11 which communicate with the preheaters 9, 10 and a pair of bleeds 19 which communicate with the preheaters 17, 18.

The vapor generator plant is suitable, inter alia, more particularly for sliding pressure operation and preferably operates at super critical pressure on full load. The following description of how the plant operates is based on the initial assumption that the feed pump delivery is at sub-critical pressure since this condition occurs on partial load even in sliding-pressure facilities which operate at super critical pressure on full load.

During normal operation, the condensate yielded in the condenser 1 is, together with the additional water inflowing through the line 3, desalinated substantially completely in the condensate treatment system 8 so that deposits of salt in the evaporator 26 are negligible. The treatment system 8 preferably comprises a cation exchanger, a $CO_2$ trickler, an anion exchanger and a mixed bed filter. After treatment, the condensate is heated by the two preheaters 9, 10, which are connected to the two bleeds 11 of the low-pressure turbine 86, and is injected into the deaerator 12 whence the condensate is delivered to the feed tank 13. The working medium, which has now ceased to be condensate and is now feed water, is pumped by the feed pump 16 to a pressure which depends upon the load of the plant and which may be supercritical pressure on full load operation. The feed water is heated in the two high-pressure preheaters 17, 18 which are supplied with bled steam from the two bleeds 19 of the low-pressure turbine 86. Feed water is given further heating to near the evaporation temperature—at subcritical pressure in the form of operation assumed—in the economizer 20, then distributed very uniformly to the tubes 27. The orifices of these tubes 27 have adjustable throttle elements (not shown) disposed in them to even out the flows.

Since the various tubes 27 are not all heated identically, the flows of working medium passing through them are heated to different extents. Hence, the quantity of water evaporating in the various tubes 27 differ from tube to tube. The throttle elements are thus adjusted so that the flows of working medium through the tubes 27 of the evaporator 26 are controlled to give the same proportion of unevaporated water at the end of each tube 27. Since the heating of the discrete tubes 27 varies because of changes in flame position or because of different soiling of the tubes on the flue gas side, the evaporator 26 is of such small dimensions that is very probable that even on partial load operation, a small amount of unevaporated water flows, even through the exit cross-section of whichever tube 27 has the worst conditions. This ensures that individual tubes do not overheat.

The mixture of vapor and water of different water content entering the headers 35 is thoroughly mixed during flow through the line 36 and, possibly still with considerable differences in water content, is distributed into the parallel tubes 41 of the final evaporator 40. Since the final evaporator 40 is disposed in a lightly heated zone of the flue gas flow—i.e., in a zone where flue gas temperature is not much higher than the temperature of the evaporating water—that surface of the evaporator 40 which is in contact with the flue gas cannot overheat dangerously despite very uneven distribution of the working medium to the tubes.

The construction of the final evaporator 40 should aim at an optimum as regards expenditure for satisfactory distribution of the vapor/water mixture at the entry of the parallel tubes of the final evaporator 40 or as regards the size of the heating surface of the final evaporator 40.

The working medium issues from the final evaporator 40, preferably slightly superheated on full load, and enters the water separator 44. After any water still present has separated out, the dry steam flows at a uniform temperature, and at a high speed ensuring satisfactory heat transfer, from the tube 50 through the wall tubes 53 forming the first superheater.

The temperature difference between the welded-together tubes 27 and 53 of the evaporator 26 and the first superheater, respectively, is mainly determined by the position of the final evaporator 40 in the flue gas flow. The latter position is such that the latter temperature difference does not cause excessive thermal stressing. The temperature difference can be limited by the provision of a means for controlling the heat yielded on the flue gas side to the final evaporator 40. Such a means can take the form, for instance, of a recirculation of the flue gas or of a bypass passage via which the flue gases can bypass the final evaporator 40. Action on the working medium to control the temperature difference can also take the form of a bypass of the final evaporator 40 or, for instance, a temperature-controlled injector associated with the ine 42.

The superheated steam issues from header 55, flows through and is further heated in the second superheater 72, and then passes by way of the injector 74 in the line 73 through the final superheater 75. Live steam line 77 connected to final superheater 75 has a temperature detector (not shown) which acts by way of a suitable means (not shown) on the injector 74.

The vapor is given a first expansion, and undergoes a corresponding temperature decrease, in the high-pressure turbine 78, then reheated in the reheater 82 and then passes to the low-pressure turbine 86 in which the vapor is expanded to the negative pressure in the condenser 1.

In normal operation, the quantity of feed water is controlled e.g. by the exit temperature of the final evaporator 40; however, for starting and in a load range below a predetermined level, the delivery of the feed pump 16 is preferably constant, leading to a water content dependent upon load at the exit of the final evaporator 40. The water is separated out in the separator 44 and returned, by way of the valve 46 which is controlled by the level in separator 44, to the feed water tank 13.

In systems for supercritical operation, it may be expedient to have a bypass with a throttle element connected in parallel with the final evaporator 40 so that on heavy-load operation, a proportion of the working medium can bypass the final evaporator 40. This feature enables the temperature difference between the tubes 27 and 53 to be reduced in the region where they are welded together, so that thermal stresses are reduced.

Thermal stresses near the planes E, F can be reduced if the tubes 27, 53 are directly welded together only over short lengths and if sealing is provided by a skin casing construction.

In designing the vapor generator, the critical load up to which working medium is recirculated over the evaporated heating surface is determined in the light of generator dimensions and likely operating conditions. If the critical level is low, it may be convenient for the water from the separator 44 to return directly to the feed water tank 13, as shown. If the critical load is fairly high, it is preferable to provide a heat exchanger (not shown) between the return line 45 and the feed water line 15, preferably downstream of the high-pressure preheater 18. Alternatively, a circulating pump can be disposed either in the feed line or return line, in which event, the two evaporators and the economizer can be included in the circulation circuit.

What is claimed is:

1. A forced flow vapor generator plant comprising treatment means for desalinating a flow of water to a conductivity of less than 0.2 microsiemens per centimeter and to a silicon content of less than 0.02 parts per million;

a high pressure feed pump for pumping a flow of water from said treatment means;

a vapor generator having a plurality of vertical tubes disposed in seal-tight relation to each other to define an evaporator about a combustion chamber, a plurality of vertical tubes disposed in seal-tight relation to each other and to said evaporator tubes to define a first superheater about a flue above said combustion chamber, an economiser within said flue connected to and between said feed pump and said evaporator to deliver a heated flow of water to said evaporator, and a final evaporator within said flue upstream of said economiser and connected to said evaporator to receive a mixture of water and vapor therefrom; and a water-separating means connected to said final evaporator to receive a mixture of water and vapor therefrom, said water-separating means having a return line communicating with a position between said treatment means and said evaporator for returning separated water thereto and a tube communicating with said first superheater to deliver vapor thereto whereby the plant is operable on a once-through flow through said evaporator in a load range above 50% of full load.

2. A plant as set forth in claim 1 wherein said final evaporator comprises a plurality of tubes and a plurality of fins on each said tube thereof.

3. A plant as set forth in claim 2 wherein said vertical tubes of said evaporator each have internally disposed helical grooves at least in a zone of maximum heat incidence.

4. A plant as set forth in claim 2 wherein said fins extend in the circumferential direction of said tubes.

5. A plant as set forth in claim 1 wherein at least one superheater is disposed within said flue upstream of said final evaporator and connected to an exit of said first superheater.

* * * * *

UNITED STATES PATENT AND TRADEMARK OFFICE

CERTIFICATE OF CORRECTION

PATENT NO. : 4,430,962

DATED : February 14, 1984

INVENTOR(S) : PAWEL MISZAK

It is certified that error appears in the above—identified patent and that said Letters Patent is hereby corrected as shown below:

Column 3, line 67, change "20" to --30--

Signed and Sealed this

*Twenty-second* Day of *May 1984*

[SEAL]

*Attest:*

GERALD J. MOSSINGHOFF

*Attesting Officer*

*Commissioner of Patents and Trademarks*